US010443249B2

(12) United States Patent
Delfeld

(10) Patent No.: US 10,443,249 B2
(45) Date of Patent: Oct. 15, 2019

(54) METHOD AND DEVICES FOR PRODUCING A FLOATING FLOOR

(71) Applicant: Keep Silence SPRL, Limal (BE)

(72) Inventor: Marc Delfeld, Limal (BE)

(73) Assignee: Keep Silence SPRL, Limal (BE)

( * ) Notice: Subject to any disclaimer, the term of this patent is extended or adjusted under 35 U.S.C. 154(b) by 0 days.

(21) Appl. No.: 16/052,092

(22) Filed: Aug. 1, 2018

(65) Prior Publication Data

US 2018/0340340 A1 Nov. 29, 2018

Related U.S. Application Data

(63) Continuation-in-part of application No. PCT/EP2017/052357, filed on Feb. 3, 2017.

(30) Foreign Application Priority Data

Feb. 5, 2016 (BE) ..... 2016/5097
Aug. 9, 2017 (BE) ..... 2017/5549

(51) Int. Cl.
*E04F 15/22* (2006.01)
*E04F 15/20* (2006.01)
*E04F 15/02* (2006.01)

(52) U.S. Cl.
CPC ..... *E04F 15/22* (2013.01); *E04F 15/203* (2013.01); *E04F 2015/02055* (2013.01)

(58) Field of Classification Search
CPC ..... E04F 15/22; E04F 15/203; E04F 2015/02055
See application file for complete search history.

(56) References Cited

U.S. PATENT DOCUMENTS

2005/0258722 A1 11/2005 Sullivan
2007/0012847 A1 1/2007 Tai

FOREIGN PATENT DOCUMENTS

EP 1251220 A2 10/2002
GB 2451686 A 2/2009
WO WO 97/47835 A1 12/1997
WO WO 2010/151135 A1 12/2010
WO WO 2015/135054 A1 9/2015

*Primary Examiner* — Joshua K Ihezie
(74) *Attorney, Agent, or Firm* — Reinhart Boerner Van Deuren P.C.

(57) ABSTRACT

The invention relates to methods and devices for mounting a floating floor on a beam structure comprising a plurality of parallel beams, the method comprising positioning a plurality of devices placed at a regular distance and fixing said devices to the beams, the devices comprising a horizontally oriented support, and at least one fixing element comprising a vertical part configured to be secured to at least one lateral wall of a beam, the support being connected to the fixing element. The method also comprises mounting joists by inserting elements consisting of an acoustic insulating material on the supports of the devices, each joist being carried by at least two supports, the combined height of the joists and the acoustic elements being such that the upper surface of the joists is located at a greater height than the beams of the beam structure, and mounting the floor on the upper surfaces of the joists. The invention is furthermore related to a cassette comprising beams and support devices, for constructing a floating floor.

29 Claims, 10 Drawing Sheets

METHOD AND DEVICES FOR PRODUCING A FLOATING FLOOR

CROSS-REFERENCE TO RELATED APPLICATIONS

This patent application is a continuation-in-part of PCT/EP2017/052357, filed Feb. 3, 2017, which claims priority to Belgian Application No. 2016/5097, filed Feb. 5, 2016. This application also claims priority to Belgian Application No. 2017/5549, filed Aug. 9, 2017. The entire teachings and disclosure of these applications are incorporated herein by reference thereto.

FIELD OF THE INVENTION

The invention relates to methods and devices intended for mounting a floor on the beams of a beam structure during the construction or the renovation of a building.

The invention furthermore relates to a floor cassette for the construction of a floating floor in a building. This floor cassette will mostly be used for the construction of new wooden buildings.

A floating floor is a floor that is not fastened to the fixed structure of the building, which gives the floor advantageous acoustic characteristics, whilst allowing long spans

PRIOR ART

A beam structure is a set of beams, often wooden beams, mounted in a parallel manner and forming the separation between two levels of a building. Spacers, often wooden spacers, are fixed between the beams to impart stiffness to the structure. It is conventional for a floor to be mounted directly on the beams. The direct contact between the floor and the beam structure results in a structure that has mediocre acoustic behavior.

Systems for executing a floating floor that is not in direct contact with the beams of the beam structure are known. In particular, the document GB 2451686 describes a device that enables the floor to be not directly attached to the beam structure. The device is mounted between two beams and itself carries a floating upright that in turn supports the floor. This device suffers from a number of drawbacks: it is formed from a thin steel plate that has a low resistance to the high forces exerted on the floor. The resistance to transverse vibrations is also low given the manner in which the device is fixed to the beam. The floating uprights must be provided with transverse channels to provide access to transverse reinforcing bars, placed under the devices that support the uprights, which further weakens the system. This particular configuration results in a system of high technical complexity and that is thus relatively uneconomic, without guaranteeing convincing acoustic results.

In the construction of wooden buildings, one solution for separating two successive storeys consists in laying floor cassettes in the form of a closed or open box comprising a panel provided with longitudinal and parallel beams fixed to a surface of the panel. Closed boxes comprise a second panel mounted parallel to the first panel, the beams then being placed between the two panels. This type of box is generally not the optimum from an acoustic point of view.

CHARACTERISTIC ELEMENTS OF THE INVENTION

The present invention relates to methods and devices as described in the claims.

According to a first aspect, the invention relates to a method for mounting a floating floor on a beam structure comprising a plurality of parallel beams, the method comprising the following steps:

- positioning a plurality of devices placed at a regular distance,
- fixing said devices to the beams, the devices comprising:
  - a horizontally oriented support configured to support a joist on which the floor rests, and
  - at least one fixing element comprising a vertical part configured to be fixed to at least one lateral wall of a beam, the support being connected to the fixing element,
- mounting joists by inserting elements consisting of an acoustic insulating material on the supports of the devices, each joist being carried by at least two supports, the combined height of the joists and the acoustic elements being such that the upper surface of the joists is located at a greater height than the beams of the beam structure,
- mounting the floor on the upper surfaces of the joists.

According to one embodiment of the method, at least one fixing element is an angle-bracket-shaped element, comprising said vertical part and a horizontal part, the horizontal part being configured to be fixed to the upper surface of a beam and the vertical part being configured to be fixed at least to a lateral wall of the same beam, the support being connected to the vertical part of the angle-bracket-shaped element, the combined height of the joists and the acoustic elements being such that the upper surface of the joists is situated at a greater height than the horizontal parts of the angle-bracket-shaped elements of the devices.

In the latter embodiment, the support may be uniform with the fixing element or the fixing elements. Still in this embodiment, the fixing elements may comprise a second horizontal part that supports the support and the support may be attached to the second horizontal part or can pivot relative to the second horizontal part about an essentially vertical axis.

Still in this embodiment, one or more of the devices may take the form of a stirrup configured to be mounted between two adjacent beams, in which:

- the stirrup comprises a central part that serves as said support, the central part being oriented horizontally when the device is mounted on the beam structure,
- the stirrup comprises two ends, each end forming one of said angle-bracket-shaped elements, the central part being connected to the vertical parts of the two ends.

According to another embodiment, the fixing element is an angle-bracket-shaped element, comprising a vertical part and a horizontal part, the vertical part being configured to be fixed at least to a lateral wall of a beam, the horizontal part being configured to carry the support. In this latter embodiment, the support may be attached to the horizontal part or can pivot relative to the horizontal part about an essentially vertical axis.

Still in this latter embodiment, one or more of the devices may take the form of a stirrup configured to be mounted on the beam structure between two adjacent beams, in which:

- the stirrup comprises a central part that serves as said support, the central part being oriented horizontally when the device is mounted on the beam structure,
- the stirrup comprises two ends, each end forming one of said angle-bracket-shaped elements, the central part being supported by the horizontal parts of the ends.

The ends of the stirrup-shaped device may be attached to the central part and oriented at obtuse angles different from 180° defined relative to the central part in a horizontal plane when the device is installed on the beam structure, said angles being opposite each other. The central part of the stirrup-shaped device may be formed by a steel or wooden bar.

The central part of the stirrup-shaped device may comprise two parts, one being movable relative to the other so as to render the length of the central part adjustable. According to one specific embodiment, the two parts of the central part in the form of bars, the first part being movable inside the second part.

In one embodiment of the method of the invention, one or more of the devices is made from a steel plate, or formed by assembling a plurality of parts of a steel plate.

One or more of the devices may be configured to be mounted on a single beam, the device comprising a support connected on one side to the vertical part of the fixing element.

According to one embodiment of the method, the devices comprise at least one stirrup and at least one of the joists is not mounted in the middle of the central part of the stirrups that support said joist.

According to a preferred embodiment, the method further comprises placing an insulating material between a plurality of pairs of adjacent beams (i.e. between the two beams of each pair).

The insulating material may be retained in place by support means that are connected to the devices. According to one specific embodiment, the placing of the insulating material comprises the steps consisting in:

- Suspending one or more laths under the supports of the devices, the laths being transverse relative to the devices,
- Mounting elements in said insulating material on the laths.

According to another embodiment, placing the insulating material comprises the steps consisting of:

- Mounting one or more strips that have straight parts and parts that are bent around the supports of the devices, the strips being transverse relative to the devices,
- Mounting elements in said insulating material on the straight parts of the strips.

The invention also relates to a device usable in the method according to the invention, the device comprising:

- a support oriented horizontally and configured to support a joist on which the floor rests,
- at least one fixing element, comprising a vertical part configured to be fixed at least to a lateral wall of a beam, the support being connected to the fixing element.

The invention also relates to a floating floor structure to be mounted on the beams of a beam structure, said structure comprising:

- a plurality of devices according to the invention,
- a plurality of joists mounted on the supports of the devices, with acoustic insulating material elements interleaved between the joists and the supports, each joist being carried by at least two supports, the combined height of the joists and the acoustic elements being such that the upper surface of the joists is situated at a greater height than the beams of the beam structure as well as, if applicable, a greater height than the horizontal parts of the devices, said horizontal parts being fixed to the upper surface of the beams,
- a floor mounted on the joists that does not come into contact with the beams of the beam structure.

According to a preferred embodiment, the floating floor structure further comprises an insulating material mounted between a plurality of pairs of adjacent beams (i.e. between the two beams of each pair).

The insulating material may take the form of elements in said insulating material that are maintained in place by support means connected to the devices. According to one embodiment of the floating floor structure, the support means comprise one or more laths suspended under the devices, the laths being transverse relative to the devices. According to another embodiment of the floating floor structure, the support means comprise one or more strips that have straight parts to support the elements in said insulating material and parts that are bent around the supports of the devices, the strips being transverse relative to the devices.

The invention also relates to a kit of parts for execution of the method according to the invention, comprising:

- a plurality of devices according to the invention and/or a plurality of components of said devices,
- a plurality of joists,
- a plurality of elements in an acoustic insulating material, to be installed between the devices and the joists,
- a plurality of panels to form the floor.

According to a preferred embodiment, the kit of parts further comprises a plurality of insulating material elements to form an insulation between a plurality of pairs of adjacent beams (i.e. between the two beams of each pair).

The kit may further comprise means for supporting the elements forming an insulation between a plurality of pairs of adjacent beams, said means being suitable for being connected to the devices.

According to one embodiment of the kit of parts, the means for supporting the elements forming an insulation between a plurality of pairs of adjacent beams comprise laths configured to be suspended under the devices whilst being oriented transversely relative to said devices.

According to another embodiment of the kit of parts, the means for supporting the elements forming an insulation between a plurality of pairs of adjacent beams comprise strips configured to be bent around the supports of the devices whilst being oriented transversely relative to said supports.

According to a second aspect, the present invention relates to a floor cassette as described in the claims. The invention relates firstly to a floor cassette for the construction of a floating floor, the floor cassette comprising a wooden base panel and a plurality of wooden beams attached to one of the surfaces of the base panel, the beams being essentially parallel to one another, wherein the floor cassette further comprises a plurality of support devices mounted between two adjacent beams, the support devices comprising two ends respectively fixed at least to a lateral wall of the two adjacent beams, and a central part connecting the two ends, the central part being configured to support the floor so that the latter is not directly attached to the beams. The beams are preferably rectangular section beams mounted upright on the surface of the base panel. The base panel is a load-bearing panel configured to rest on two lateral walls or equivalent support structures, such as two rows of support columns for example. The panel has sufficient thickness and thereby mechanical strength to serve as a base for a building level. This implies that the floor cassette itself is a structural element, that is to say a load-bearing element configured to support the loads caused by persons and objects located on a storey of a building.

According to one embodiment of the cassette according to the invention, the support devices are formed and sized so that the central parts of the support devices mounted on a plurality of pairs of adjacent beams are respectively able to support a plurality of joists configured to support the floor, a resilient material acoustic element being placed between each central part and the joist that it supports.

According to one embodiment of the cassette, a plurality of acoustic elements respectively attached to the central parts of the support devices form part of the floor cassette.

According to one embodiment, a plurality of said joists attached to the acoustic elements form part of the floor cassette.

According to one embodiment, the floor cassette comprises a part of said floor attached to the joists.

According to one embodiment, the floor cassette comprises a thermal insulation material between the base panel and the support devices and/or above the support devices.

According to one embodiment, the base panel has a rectangular shape in which the length of the base panel exceeds the length of the beams on both sides of said beams.

According to one embodiment, the beams are attached to the surface of the base panel by at least a glue.

According to one embodiment, said glue is a polyurethane-based glue applicable in liquid form and hardening with moisture from the wood and/or from the air.

According to one embodiment, the length of the floor cassette measured in the direction of the beams is between 6 and 12 m and the width of the floor cassette is between 1 and 3 m.

According to one embodiment, the support devices are mounted alternatingly on the channels formed by the beams.

According to one embodiment of the cassette, at least one end of the support devices is an angle-bracket-shaped element comprising a vertical part and a horizontal part, the horizontal part being fixed to the upper surface of a beam and the vertical part being fixed to a lateral wall of the same beam, the central part being connected to the vertical part.

According to one embodiment of the cassette, the ends comprise a second horizontal part that supports the central part.

According to one embodiment of the cassette, the ends are angle-bracket-shaped elements comprising a vertical part and a horizontal part, the vertical part being fixed to a lateral wall of a beam, the horizontal part supporting the central part of the support device.

According to one embodiment of the cassette, the ends are fastened to the central part and oriented at obtuse angles different from 180° defined relative to the central part in a horizontal plane when the floor cassette is installed, said angles being opposite one another.

According to one embodiment of the cassette, the central part of the support devices is formed by a steel or wooden bar.

According to one embodiment of the cassette, one or more of the support devices is fabricated from steel plate or formed by the assembly of a plurality of parts of a steel plate.

According to one embodiment of the cassette, the length of the central part of at least one of the support devices is adjustable when said device is removed from the floor cassette.

The invention is further related to a floating floor comprising one or more floor cassettes according to the invention.

The invention is also related to the use of one or more floor cassettes according to the invention for the construction of a floating floor.

DETAILED DESCRIPTION OF THE INVENTION

According to a first aspect, the invention utilizes support devices intended to be mounted between two beams of the beam structure or on a single beam, so as to be able to support a floor, whilst making it possible for this floor to be not directly attached to the beam structure (floating floor). It should be noted that the various embodiments are described in the situation where the floor is positioned in an essentially horizontal manner on a beam structure, itself comprising a plurality of parallel beams disposed horizontally.

Figure 1:
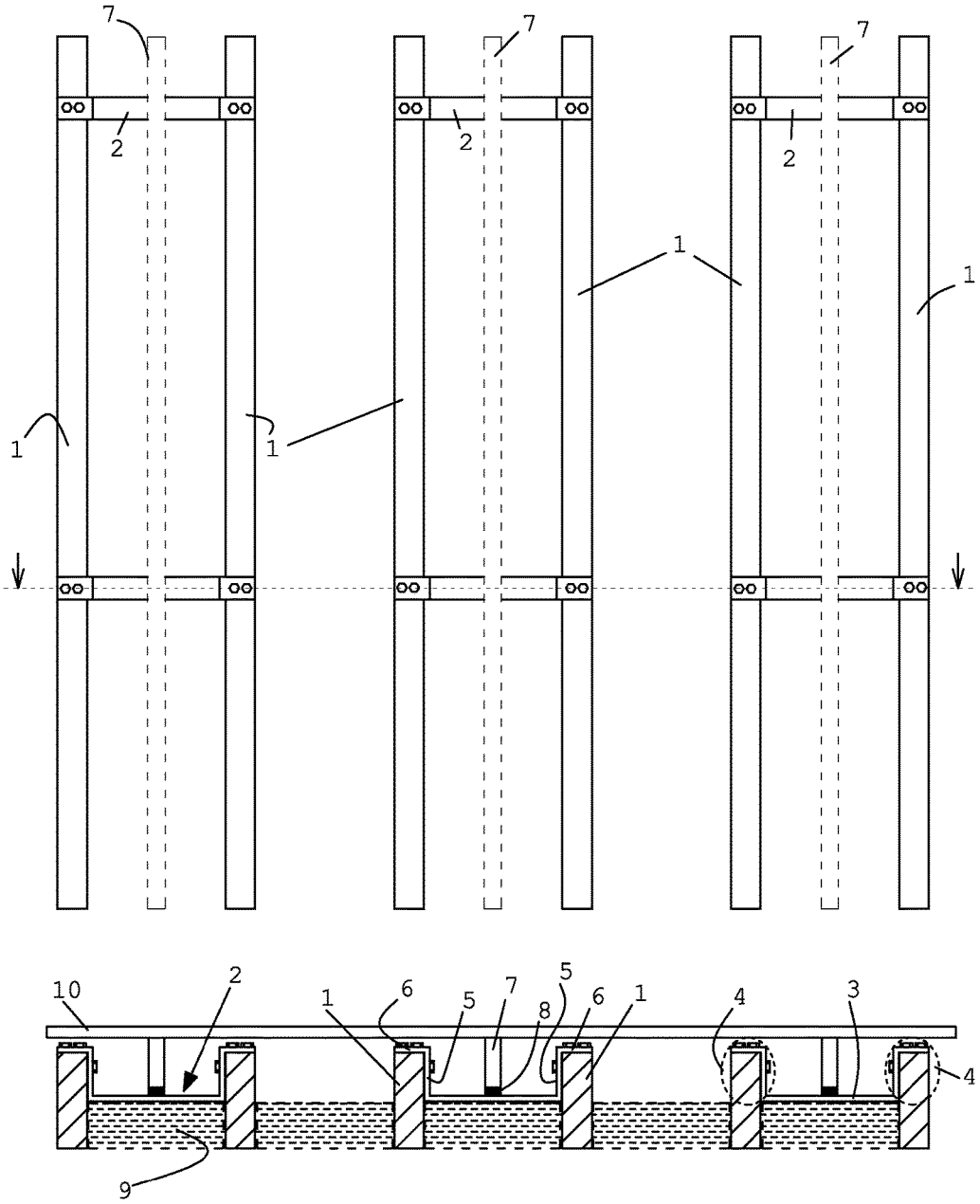
FIG. 1 represents the installation of a plurality of devices according to the invention on a beam structure for supporting a floor that is not directly attached to the beam structure.

FIG. 1 shows plan and front views of a plurality of beams 1 that form a beam structure and that are provided with devices in the form of stirrups 2 according to one embodiment of the invention. Each of the stirrups 2 comprises a central part 3 and two ends 4 that constitute angle-bracket-shaped fixing elements. Each end (when in position) comprises a vertical part 5 and a horizontal part 6. The ends 4 are fixed to the beams 1, by fixing the horizontal parts 6 to the upper surface of the beams, preferably using vertical screws. The vertical parts 5 of the ends are fixed to the lateral walls of the beams, preferably by means of horizontal screws. This double fixing of the ends 4, facilitated by the angle-bracket shape of these ends, provides a high resistance to transverse vibrations and ensure that the beams are tied together.

The central part 3 of the stirrups is oriented horizontally and functions as a support for a joist 7 that rests on an element 8, preferably a block of resilient material, that serves as acoustic insulation. The floor 10 is in turn supported by the joists 7. The floor 10 may for example be screwed to the joists 7. In the embodiment represented in FIG. 1, the total height of the element 8 and the joist 7 is greater than the height of the vertical parts 5 of the two ends 4, so that the floor 10 is not directly attached to the beam structure.

The joists 7 are supported by at least two stirrups 2 placed at a regular distance, for example at a distance of 2.5 m for a beam structure in which the distance between the beams 1 is approximately 40 cm. In the example shown, the joists 7 are placed in the middle of the central parts 3 of the stirrups.

A particular advantage of the invention is precisely that the joists 7 may be placed outside the central zone of the central parts 3, according to the requirements and constraints of the building. This enables great flexibility that is above all useful in the case of renovating a floor where beam structures comprising beams at variable distances are often encountered.

It is sometimes necessary to add additional beams to reinforce the structure. The appropriate placement (with some flexibility) of the joists 7 enables better distribution of the forces, which can result in a reduction of the number of beams 1 to be added. An insulating material 9 such as rock wool may be placed in the spaces located between the beams and under the stirrups/supports. In one specific embodiment of the invention, this insulating material 9 fills not only the space under the stirrups/supports but also above these elements, and therefore the spaces that are located on either side of the joists 7.

As already mentioned, an advantage of the embodiment represented in FIG. 1 consists in the fastening of the device 2 not only to the horizontal surface of the beams 1 but also to the lateral walls of the beams. This does not imply that the addition of the length of the central part 3 and twice the thickness of the vertical parts 5 must correspond exactly to the distance between the beams 1.

Figure 2:
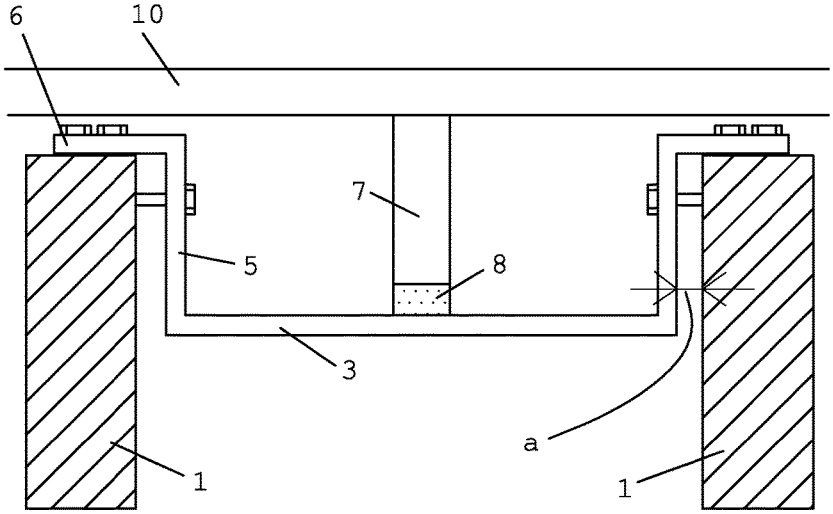
FIG. 2 represents an installation in which the distance between two beams of the beam structure is greater than the length of the central part of the device.
Figure 3:
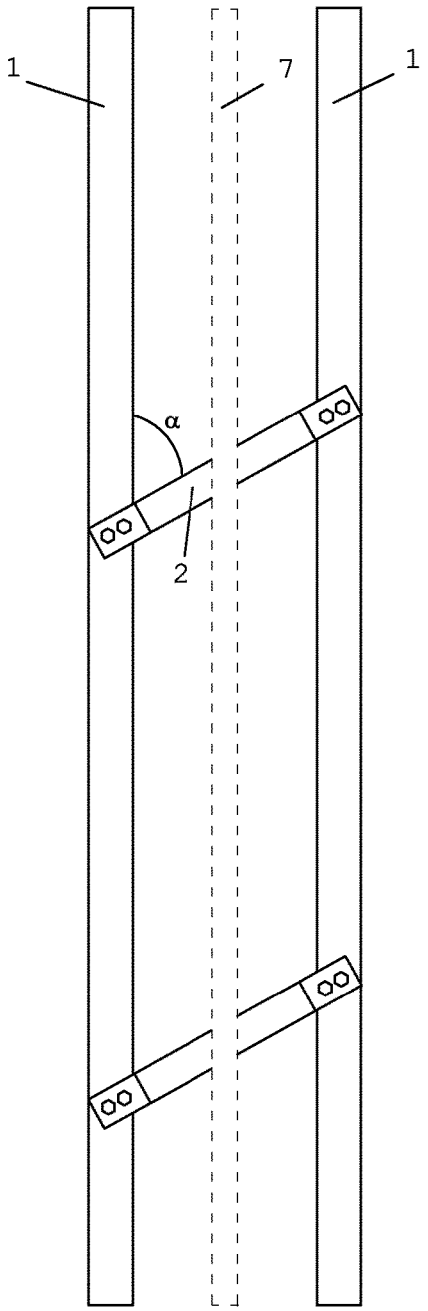
FIG. 3 represents an installation in which the devices are oriented at a non-perpendicular angle relative to the beams of the beam structure.

As shown in FIG. 2, a certain clearance (distance 'a') between the vertical parts 5 and the beams 1 is allowed and does not prevent said fastening, provided that the distance 'a' remains less than a given value. Variability of the distance between the beams therefore does not represent an obstacle to the use of the device 2 according to the invention. When the distance between two beams is less than the length of the central part 3, the stirrups 2 may be mounted to form an angle $\alpha$ (not a right angle) relative to the beams 1, as shown in FIG. 3. It remains possible to fasten the vertical parts 5 against the walls of the beams 1 by screwing them thereto, provided that the angle $\alpha$ remains less than a given value.

Figure 4:
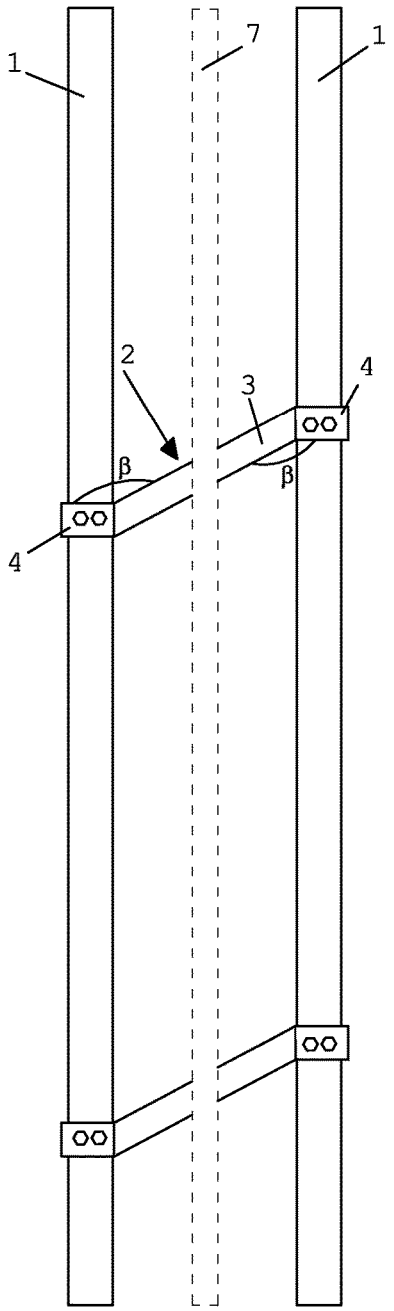
FIG. 4 represents an embodiment in which the ends of the device are oriented at an obtuse angle relative to the central part.

FIG. 4 shows an embodiment that is particularly advantageous in the case of beams at short intervals. The ends 4 are oriented at an obtuse angle (that is to say at an angle $\beta$ between 90° and 180°) relative to the central part 3, the orientation of one end 4 being opposite the orientation of the other end 4, so that the same angles $\beta$ and $-\beta$ are present between the central part 3 and each of the ends 4. This embodiment makes it possible to mount the stirrup 2 between two beams that are located at a distance less than the length of the central part 3 whilst maintaining the optimum fastening between the stirrup 2 and the horizontal surface of the beams 1 and the lateral surfaces of the beams 1.

A number of embodiments of the stirrups 2 may be envisaged. The stirrups 2 that are represented in FIGS. 1-4 are preferably made from a steel plate, or formed by an assembly of a plurality of parts of a plate (including the angle-bracket-shaped parts 4 and the central part 3 that are produced from plates). According to preferred embodiments, the plate has a thickness of 4 to 7 mm, preferably of 5 to 7 mm.

Figure 5:
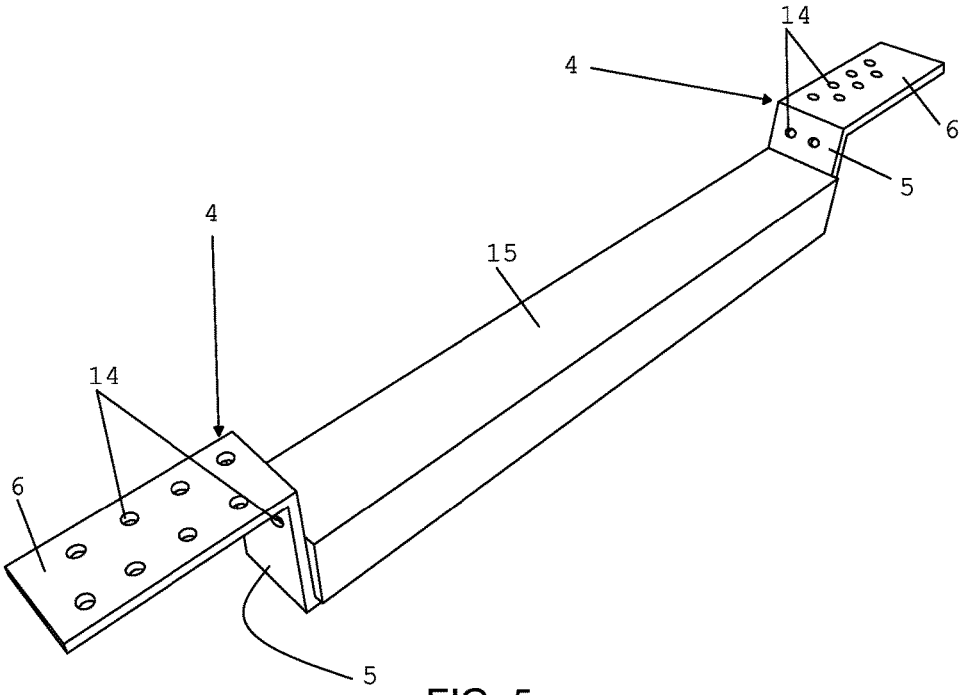
FIG. 5 represents an embodiment in which the central part of the device is formed by a steel bar.

FIG. 5 shows a stirrup the central part of which is in the form of a steel bar 15 connected to the ends 4 by welding. This shape combines the features described above and has high mechanical strength. The ends 4 take the form of angle-bracket-shaped parts connected to the central bar. These are preferably steel parts, made from steel plates between 4 and 7 mm (preferably between 5 and 7 mm) thick, welded to the bar 15. The ends 4 are provided with holes 14 in their vertical parts 5 and horizontal parts 6 to facilitate vertical and horizontal screwing of the ends 4 against the beams 1.

Figure 6:
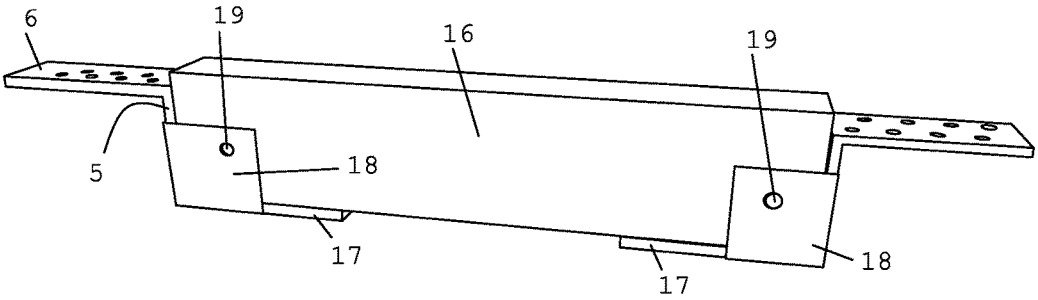
FIG. 6 represents an embodiment in which the central part of the device is formed by a wooden bar.

An alternative is shown in FIG. 6: the central part 3 of the stirrup is a wooden bar 16 that is connected to the steel angle-bracket-shaped ends 4 provided with horizontal plates 17 that support the bar 16 and vertical plates 18 that retain the bar in place. Openings 19 may be provided for screwing the bar 16 to the vertical plates 18. The wood utilized for the bar 16 must have a sufficient mechanical force resistance.

Figure 7:
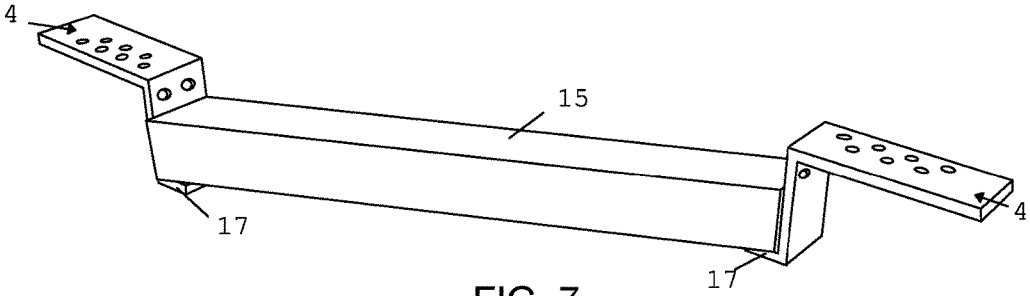
FIG. 7 represents a 3D image of an embodiment in which the ends of the device are oriented at an obtuse angle relative to the central part.

FIG. 7 shows the device with the central part in the form of a bar 15, and with the ends 4 oriented at an obtuse angle relative to said bar 15. This embodiment represents a specific embodiment of the devices shown in FIG. 4. It is seen that in this embodiment, horizontal plates 17 that are positioned under the bar 15 are attached to the ends 4. The horizontal plates 17 are preferably also present in the embodiment shown in FIG. 5.

Figure 8:
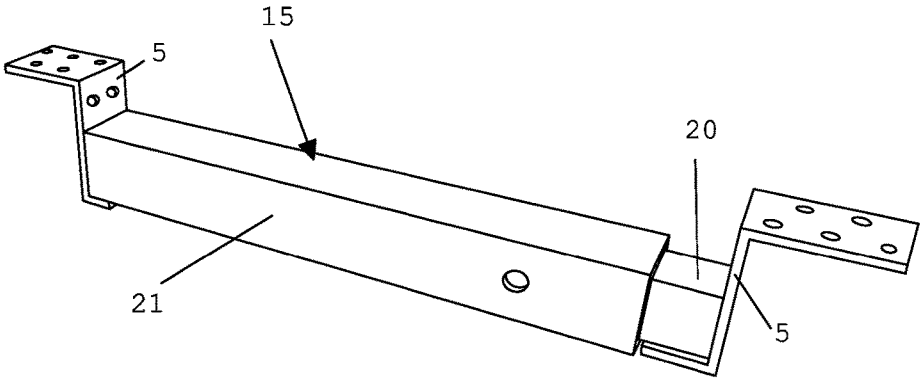
FIG. 8 represents an embodiment in which the length of the central part can be adjusted or modified.

A particularly advantageous embodiment is shown in FIG. 8. The steel bar 15 is designed in two parts 20 and 21, one being movable relative to and inside the other so as to adjust and to modify the length of the bar. This solution makes it possible to assemble the stirrups in an optimum manner, that is to say with the vertical parts 5 of the ends 4 in contact with the walls of the beams 1, catering for great variability of the distance between the beams.

Other embodiments that have an adjustable length may be imagined by the person skilled in the art.

Figure 9:
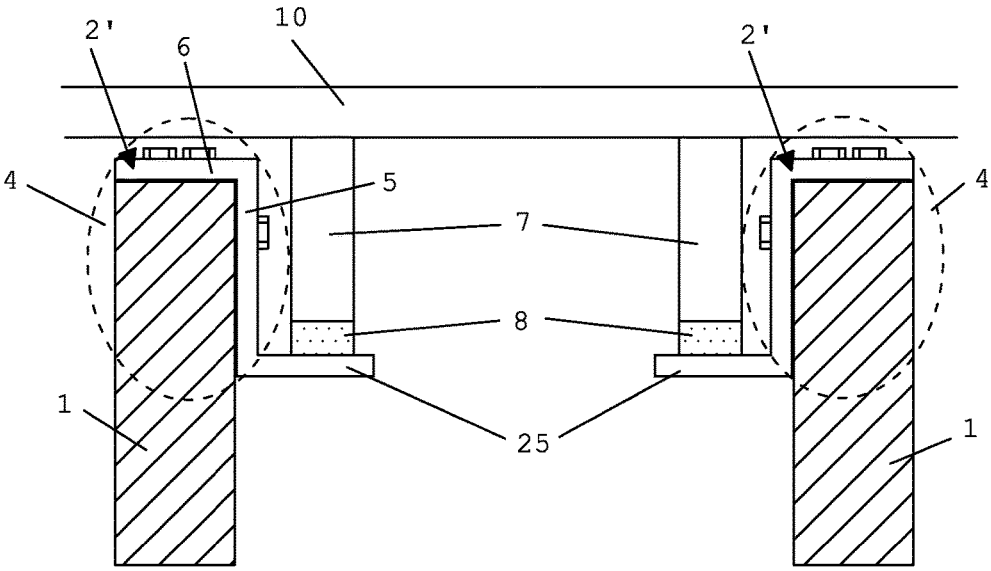
FIG. 9 represents an alternative embodiment of the invention.

Another embodiment is shown in FIG. 9. This device is an element 2' configured to be mounted on a single beam 1 of the beam structure. The element 2' comprises a horizontal support 25 attached to a fixing element 4 of angle-bracket shape the shape and the function of which correspond to the ends 4 of the first embodiment. The angle-bracket-shaped element 4 therefore comprises a horizontal part 6 and a vertical part 5, each attached to a beam 1, preferably using screws. The horizontal support 25 supports a joist 7 and the acoustic elements 8 that in turn support the floor 10. In the example given in FIG. 9, two elements 2' according to this latter embodiment are mounted either face-to-face or in a quincunx arrangement, each carrying a joist 7 and an acoustic element 8. The horizontal support 25 may be provided with a vertical extension at its distal end, so that the joist 7 is mounted between said vertical extension and the vertical part 5. The vertical extension may serve to retain the joist laterally.

Figure 10:
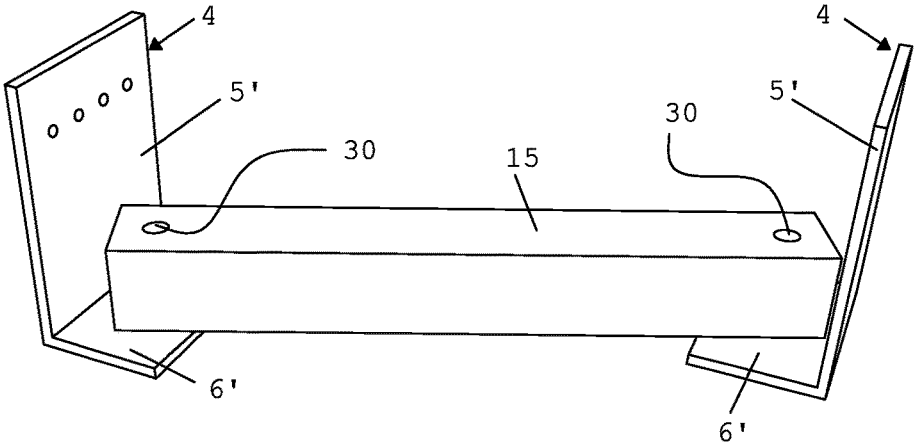
FIGS. 10 and 11 represent alternative embodiments of the device intended to support the joists.
Figure 11:
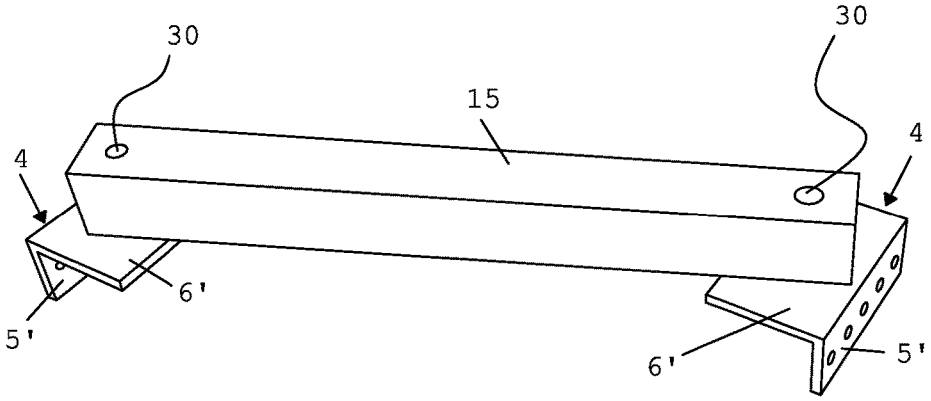

According to another embodiment, angle-bracket-shaped fixing elements 4 are used but the horizontal parts are not connected directly to the beams of the beam structure. Said horizontal parts serve as supports for a horizontal support. Two examples of this embodiment are shown in FIGS. 10 and 11. It is seen that each fixing element 4 consists of a vertical part 5' screwed against the lateral wall of a beam and a horizontal part 6' that carries a bar 15 that serves as a horizontal support. In this embodiment, the floor is closer to the beams because of the absence of a part of the ends 4 on the upper surface of the beams 1. The bar 15 may be replaced by a horizontal support 3, 16, 25, 20+21 according to any of the other embodiments described above or equivalent embodiments.

The bar 15 can advantageously pivot relative to the horizontal parts 6' about a vertical axis on pivot pins 30, whilst maintaining the contact between the bar 15 and said horizontal parts 6'. This embodiment therefore enables adjustment of the angle of the central bar 15 relative to the ends 4 so as to adapt the stirrup as a function of the distance between two beams. The feature of a horizontal support that can be pivoted relative to horizontal parts 6' of the fixing elements 4 is not limited to the embodiments of FIGS. 10 and 11. All the embodiments of the horizontal support (3, 16, 25, 20+21), described in the present specification, together with equivalent embodiments, may be configured in a pivotable manner as mentioned above. For example, in the embodiment shown in FIG. 7, the bar 15 can be pivotable relative to the horizontal plates 17.

Figure 12A:
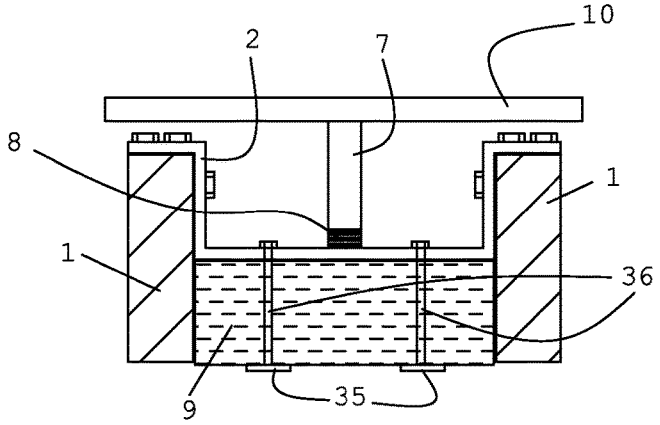
FIGS. 12*a* and 12*b* represent other embodiments that include means for supporting an insulating material.
Figure 12B:
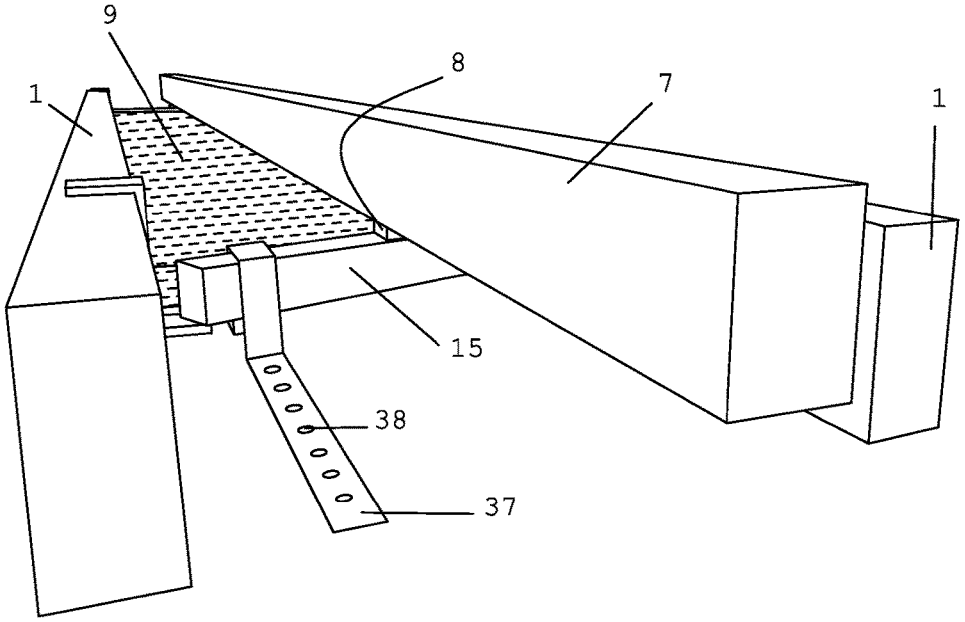

According to one embodiment, the insulating material 9 mounted under the stirrups 2 or elements 2' (FIG. 9) is retained in place by support means connected to the stirrups 2 or to the elements 2'. FIG. 12*a* represents a first variant of this embodiment, in which transverse laths 35 are connected to the stirrups 2. The laths 35 are suspended from the stirrups with the aid of rods 36 or the like (for example steel wires) to support the insulation 9. FIG. 12*b* represents a second variant: the insulation is supported by a strip 37, preferably made of steel and preferably comprising perforations 38, which has parts that are folded around the bars 15 (or the like) of the stirrups 2 as well as flat parts to support the insulating material elements 9. The strips 37 are easier to fit than the rods 36. The retention of the insulation in place (by the laths 35, the strips 37 or other like supporting means) guarantees slowing of the carbonization of the wood in the event of a fire arriving from below and therefore makes it possible to ensure fire protection with a rock wool type insulation of a given density. The laths 35 can also serve as fixing structures for ceiling panels. The means for supporting the insulating material 9, such as the laths 35 or strips 37, are usable in combination with each of the embodiments described in the present specification.

The method according to the invention for mounting a floating floor on a beam structure comprises the steps of:

- placing on the beams 1 of the beam structure a plurality of devices such as the stirrups 2 and/or the elements 2' suitable for mounting on a single beam (see FIG. 9) in accordance with any one of the embodiments described or equivalent embodiments,
- mounting joists 7 with the insertion of elements 8 consisting of an acoustic insulating material on the supports 3,15,16,25 of the devices, each joist being carried by at least two devices, the combined height of the joists 7 and the acoustic elements 8 being such that the upper surface of the joists is situated at a greater height than the beams 1 of the beam structure. In the situation where the devices comprise a horizontal part 6 mounted on the upper surface of the beams 1, the upper surface of the joists 7 is situated at a height greater than that of said horizontal part 6 (which can include where applicable the screws that fix the horizontal part 6 to the beams). The upper surface of the joists is preferably situated at least 1 cm above the upper surface of the beams or the horizontal parts 6,
- mounting the floor 10 on the upper surfaces of the joists 7.

Moreover, the method preferably comprises placing insulating material elements 9 between a plurality of (normally all of) the pairs of adjacent beams. This insulating material is preferably a material that has acoustic insulation properties. Rockwool elements, such as mats or panels may be used. Elements of a dense insulating material, such as high-density rock wool, are preferably used. The elements 9 preferably have a density of at least 45 kg/m$^3$. The elements 9 may be retained in place by being gripped between said beams.

According to specific embodiments of the method, the placing of the insulating material elements 9 is effected by fixing to the devices 2 or 2' means for supporting the insulating material 9, such as the laths 35, the rods 36 or the strips 37 described above, which will improve the retention in place of the insulating material. In combination with a material of high density, this will increase the fire resistance of the building. The elements 9 essentially fill the space between two beams, at least under the devices 2 or 2', where applicable in a manner locally interrupted at the level of the devices 2 or 2', for example in the case of the use of strips 37, as shown in FIG. 12*b*.

The invention also relates to a floating floor structure mounted on a beam structure, and comprising:

- a plurality of devices such as the stirrups 2 and/or the elements 2' suitable for mounting on a single beam (see FIG. 9), in accordance with any of the embodiments described or equivalent embodiments, mounted on the beams 1 of the beam structure,
- a plurality of joists 7 mounted on the supports 3,15,16,25 of the devices, with acoustic insulating material elements 8 inserted between the joists and the supports, each joist 7 being carried by at least two supports, the combined height of the joists 7 and the acoustic elements 8 being such that the upper surface of the joists is situated at a height greater than that of the beams of the beam structure; in the situation where the devices comprise a horizontal part 6 mounted on the upper surface of the beams 1, the upper surface of the joists 7 is situated at a height greater than that of said horizontal part 6,
- a floor 10 mounted on the joists 7 that does not come into contact with the beams 1 of the beam structure,
- preferably, an insulating material 9 between a plurality of pairs of adjacent beams 1. In accordance with preferred embodiments of the floor, the insulating material is formed by elements 9 retained by means for supporting the insulating material, such as the laths 35 with the rods 36 or the strips 37.

The floor 10 may be made from any material available for this purpose, such as OSB (Oriented Strand Board) panels. The floor may comprise a plurality of layers. According to a specific embodiment, fiber cement panels are used for the floor 10. According to another embodiment, the floor is provided with an underfloor heating system.

The invention relates finally to a kit of parts for the construction of a floating floor on a beam structure, said kit of parts comprising:

- a plurality of devices such as the stirrups 2 and/or the elements 2' suitable for mounting on a single beam (see FIG. 9), in accordance with at least one the embodiments described or equivalent embodiments, and/or a plurality of components of said devices,
- a plurality of joists 7,
- a plurality of acoustic insulating material elements 8, to be installed between the devices 2 or 2' and the joists 7,
- a plurality of panels for forming the floor 10, preferably, a plurality of insulating material elements 9 to form an insulation between a plurality of pairs of adjacent beams.

According to specific embodiments, the kit of parts also comprises means for supporting the insulating elements 9, such as the laths 35, the rods 36 or the strips 37.

According to one specific embodiment of the method, of the floor structure and of the kit of parts according to the invention, the joists or at least some of the joists 7 are formed by a metal bar (preferably a steel bar) with a wooden part mounted on the bar. The metal part imparts better stiffness to the joist, whilst the wooden part enables the screwing on of the floor panels.

The fact that the floor 10 is not directly attached to the beams 1 of the beam structure in combination with the acoustic material element 8 allows the construction of a floor that has better vibration damping qualities. The devices that support the joists (stirrups 2 according to different embodiments described as well as devices 2' for a single beam) are robust and enable fixing to the lateral surfaces and preferably also to the upper surfaces of the beams. These features enable the implementation of a floor that is supported only by said devices and not by the beam structure itself.

Another advantage of the invention consists in the recovery of flatness of the beams at a much lower cost and with much easier implementation than with any other prior art solution. It suffices to place the ends 4 of the devices 2 or 2' at a common level, which represents a time saving.

Moreover, the support devices of the joists allow flexibility in terms of the placement of the joists 7 (in the middle or away from the middle for example), as well as flexibility in terms of mounting the devices 2 or 2' on beam structures with a variable spacing between the beams.

According to a second aspect, the invention is furthermore related to a floor cassette for the construction of a floating floor, wherein the floor cassette is provided with stirrup-type support devices as described above.

Figure 13:
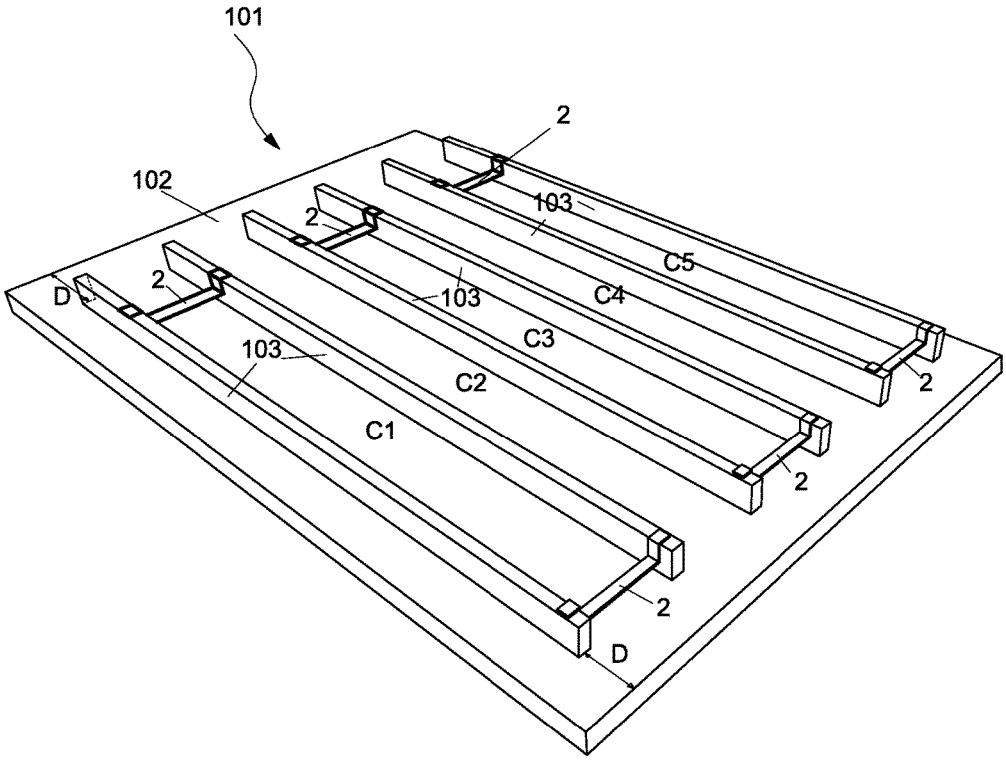
FIG. 13 represents a floor cassette according to one embodiment of the invention.

In FIG. 13 a floor cassette 101 according to a first embodiment of the invention for the construction of a floating floor is shown. The floor cassette 101 comprises a base element in the form of a wooden panel 102, preferably having a thickness between 25 and 75 mm and preferably formed of laminated wood such as LVL (Laminated Veneer Lumber). According to this preferred embodiment, the thickness of the base panel 102 is at least 33 mm. Depending on the material used, the use of a base panel at least 33 mm thick, preferably at least 50 mm thick, enables a floor cassette to be produced that resists fire for at least one hour. The base panel 102 preferably has a rectangular shape but may of course be adapted to any other shape. According to one embodiment of the invention, the width of the panel is between 1 and 2.5 m while the length may vary between 6 and 12 m. Wooden beams 103, preferably of rectangular section, are fixed upright on the upper surface of the base panel 102, the beams being mounted parallel to one another and oriented in the longitudinal direction of the rectangle constituting the upper surface of the panel 102. The beams 103 are preferably placed equidistantly, for example with a distance of approximately 40 cm between two adjacent beams. The beams 103 may equally be produced in laminated wood such as LVL. In the embodiment represented in the figures, and without constituting a limitation on the scope of the invention, the thickness of the beams 103 of a floor cassette 101 is preferably of the same order of magnitude as the thickness of the base panel 102 of said floor cassette 101.

According to a preferred embodiment, the base panel 102 extends beyond the beams by a distance D measured in the longitudinal direction of the beams 103. This distance D will preferably be the same at both ends of the beams 103. The beams 103 are fastened to the base panel 102. According to a preferred embodiment, the fastening means provided consist of a glue that is described hereinafter in relation to the method of assembling the floor cassette.

Moreover, the floor cassette of the invention comprises a plurality of support devices 2, which may be any type of the stirrup-type support device described above, each of these devices being mounted between two adjacent beams 103 so as to be able to support a floor (not represented in FIG. 13), whilst allowing this floor not to be directly attached to the beams 103 of the floor cassette 101.

According to embodiments of the invention, the support devices 2 are formed and sized so that they allow the supporting of joists oriented essentially parallel to the beams 103 and on which the floor will be mounted. At least two support devices 2 are mounted between two adjacent beams 103. The support devices 2 are preferably installed alternately in the hollows or channels formed by the beams, as shown in FIG. 13: the floor cassette 101 comprises 6 beams 103, separated by 5 channels C1 to C5, support devices 2 being mounted in channels C1, C3 and C5. The floor cassette represented in FIG. 13 has a limited length that enables the various elements to be seen clearly: it comprises only two support devices 2 mounted on each of channels C1, C3 and C5. Of course, the floor cassette may have a greater length, which will necessitate a greater number of support devices 2. The support devices 2 mounted on a pair of beams 103 may for example be placed at a distance from one another between 1 and 4 m.

Figure 14:
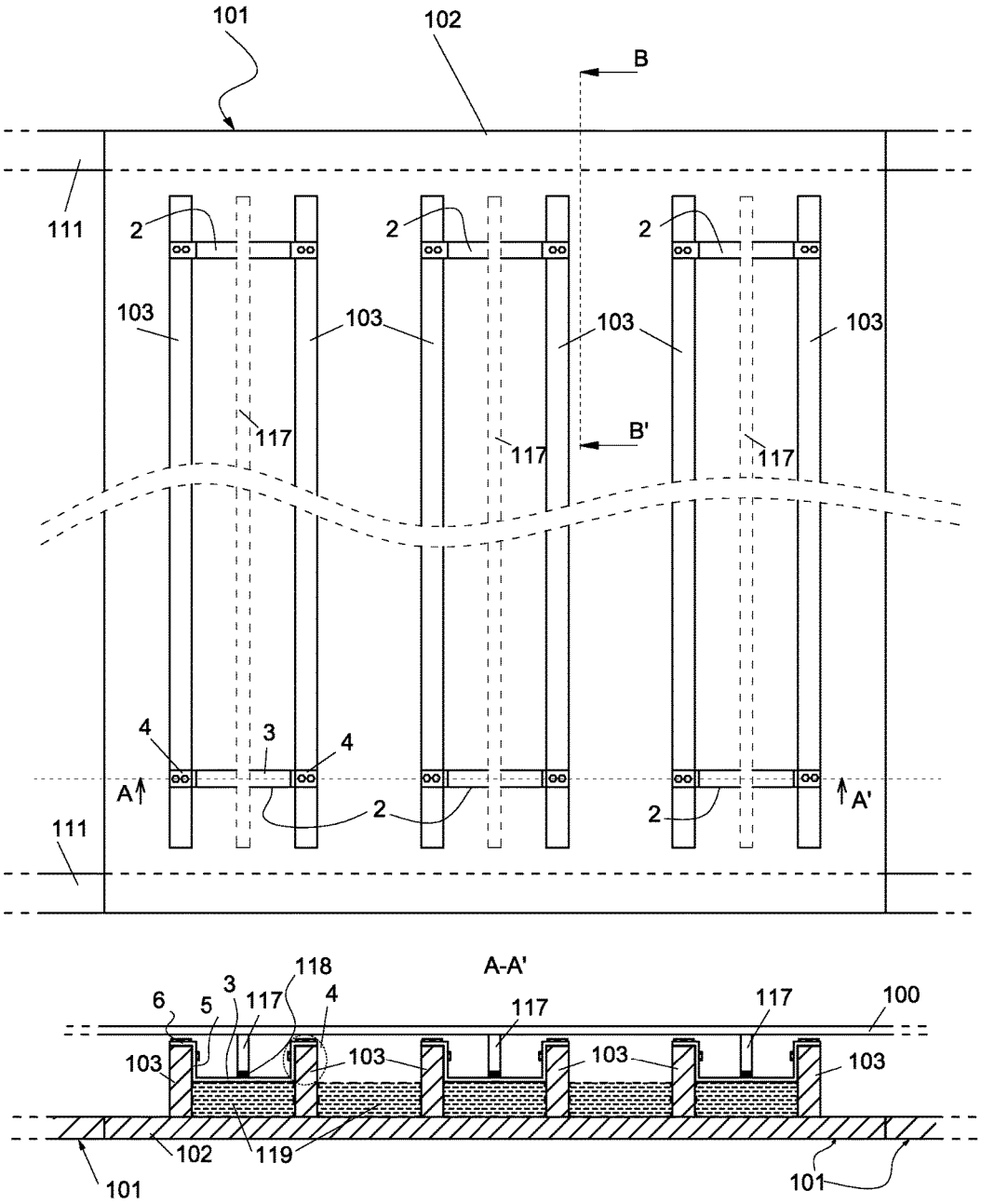
FIG. 14 represents plan and front views of a floor mounted on a plurality of floor cassettes according to the invention, resting on two walls.

FIG. 14 represents plan and front views of a floor 100 installed on a plurality of floor cassettes 101 as defined by the present invention. A single floor cassette 101 is represented in the figure, although the floor 100 may be supported by a plurality of floor cassettes mounted alongside one another (which is symbolized by the dashed ends of the lines in FIG. 14). The base panel 102 and the beams 103 can be seen. The longitudinal ends of the panel rest on two lateral walls 111. The support devices 2 represented in FIGS. 13 and 14 are stirrup-shaped. Each of the stirrups 2 comprises a central part 3 and two ends 4 that constitute angle-bracket-shaped fixing elements. Each end 4 comprises a vertical part 5 and a horizontal part 6. The ends 4 are fixed directly to the beams 103, by fixing the horizontal parts 6 to the upper surface of the beams 103, preferably using vertical screws. The vertical parts 5 of the ends are fixed to the lateral walls of the beams 103, preferably by horizontal screws. This double fixing of the ends 4, facilitated by the angle-bracket shape of these ends, enables resistance to transverse vibrations to be provided. On the other hand the invention is not limited to the shapes of the support devices 2 as shown in the figures. As a general rule, the support devices 2 comprise a central part 3 and two ends 4, these ends comprising at least one vertical part 5 fixed to a lateral wall of a beam 103, the central part 3 connecting the ends 4.

The central part 3 of the support devices 2 operates as a support for a joist 117, for example in metal or in wood or in a combination of the two, which rests on an acoustic element 118, preferably a block of resilient material, which serves as acoustic insulation. The floor 100 is in its turn supported by the joists 117. The floor 100 may for example be screwed to the joists 117. The total height of the elements 118 and the joists 117 is calculated so that the floor 100 does not come into contact with the beams 103 of the floor cassettes 101. In other words, the upper surface of the joists 117 is situated at a greater height than the beams 103 of the cassette 101. The floor 100 is thereby not directly attached to the beams 103. If the ends of the support devices 2 comprise ends 4 that extend on the upper surface of the beams 103 (as is the case in FIGS. 13 and 14) the combined height of the blocks 118 and the joists 117 is such that the floor 100 is also not directly attached to these ends themselves, nor to the means for fixing them to the beam (such as the screws attaching the horizontal parts 6 to the beams 103).

The joists 117 are supported by at least two stirrups 2 placed at a regular distance, for example at a distance of 2.5 m for a distance between the beams 103 of approximately 40 cm. In the example shown, the joists 117 are placed at the middle of the central parts 3 of the stirrups.

The preferred embodiment of a floor cassette 101 according to the invention comprises the base panel 102, the beams 103 fixed to the panel and a plurality of support devices 2 such as the stirrups fixed to the beams 103.

On site, the ends of the base panel 102 that extend beyond the beams 103 are placed on two supporting walls 11 or on any equivalent pair of support structures, e.g. two rows of pillars, or a row of pillars on one side and a wall on the other. The insulating material blocks 118, the joists 117 and the floor 100 are in this case assembled in situ. According to another embodiment, the acoustic elements 118 form part of the floor cassette 101 as produced and shipped to the site. The elements 118 may be glued to the central parts 3 of the support devices 2. According to a further embodiment, the elements 118 and the joists 117 form part of the floor cassette 101. The joists 117 may in this case be glued or retained beforehand on the elements 118 which are themselves preferably glued to the central parts 3 of the support devices 2. According to a further embodiment, the floor cassette of the invention is provided with the elements 118, the joists 117 and also a part of the floor 100, preferably a part the area of which corresponds to the area of the floor cassette. The floor part is preferably mounted on the joists 117 in a way that is known in the art for the assembly of a floor on a set of joists. After assembling a plurality of floor cassettes of this type, the various parts of the floor will preferably be connected together by appropriate connecting means.

There will advantageously be placed in the spaces located between the beams 103 and below the support devices 2 a thermally insulating material 119 such as rock wool. For example rock wool with a density of at least 35 kg/m$^3$ may be placed during the construction of the floor using floor cassettes 101 according to the invention. This insulating material 119 may fill not only the spaces under the support devices 2 but also above these devices, thus the spaces located on either side of the joists 117. According to one embodiment, the thermally insulating material 119 forms part of a floor cassette according to the invention, and the floor cassette arriving on site is therefore provided with thermally insulating material 119 under and/or above the support devices 2.

Figure 15:
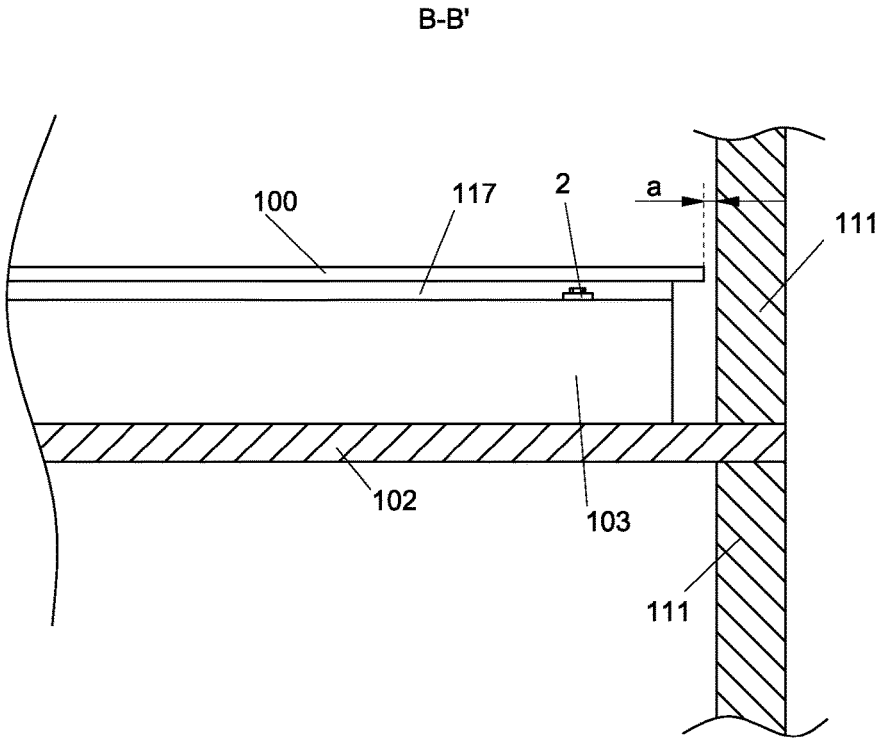
FIG. 15 represents a view in section in a plane perpendicular to the walls.

FIG. 15 represents a view in section in a plane perpendicular to the walls 111. It is seen therein that the floor 100 is separated from the walls 111 by a distance 'a'. The floor is therefore entirely 'floating', i.e. not only is it not directly attached to the beams 103 but it is also not directly attached to the walls 111. Thanks also to the presence of the resilient material block 118, there is therefore no rigid connection between the floor 100 and the fixed structure of the building, which represents an ideal situation acoustically. The noise generated by persons or tools carried by the floor 100 is not or not greatly distributed to the other storeys of the building. The floor cassette 101 according to the invention allows this floating floor construction on each storey of a new building, thus creating an acoustic solution for the entire building.

The support devices 2 may be assembled at an angle $\alpha$ (not a right angle) relative to the beams 103, in the same way as shown with respect to the beams 1 of a beam structure, as shown in FIG. 3. Fastening the vertical parts 5 against the walls of the beam 103 using screws remains possible, provided that the angle $\alpha$ remains below a given value.

The embodiments of the stirrup-type support element shown in FIGS. 4 to 8 and in FIGS. 10 and 11 are applicable as such in a floor cassette according to the invention. The above paragraphs describing these embodiments are therefore applicable to the support devices 2 of a cassette in accordance with the invention.

For example, the support device 2 shown in FIG. 4 allows the device 2 to be mounted between two beams 103 of a cassette according to the invention, located at a distance less than the length of the central part 3 whilst maintaining the optimum fastening between the device 2 and the horizontal surface of the beams 103 and the lateral walls of the beams 103.

The embodiments of the support 2 having a central part 3 that is pivotable relative to the ends 4, as illustrated in FIGS. 10 and 11, with the central part 3 (being the bar 15 in the case of the figures in question) being pivotable about pins 30, is applicable in a cassette according to the invention. This embodiment allows adjustment of the angle of the central part 3 (for example the bar 15) relative to the ends 4 so as to adapt the support device as a function of the distance between two beams 103 during the assembly of a floor cassette 101 according to the invention or when the support device 2 is removed from the floor cassette 101.

Likewise, the support device that is adjustable in length, as shown in FIG. 8 is usable for the assembly of floor cassettes 101 according to the invention, that comprise beams 103 placed at different or variable distances.

As already mentioned, the beams 103 of a floor cassette 101 according to the invention are preferably glued to the base panel 102. In a preferred embodiment, the beams 103 are made of laminated wood and the glue used is a glue based on polyurethane (PUR), which is applied in liquid form and which hardens with moisture from the wood and/or the surrounding air, and under the impact of a contact pressure between the glued components. One glue that may be used is Jowapur® type 686.60 glue. The glue is preferably applied over the entirety of the face of the beams (full dip application) in contact with the panel by an automated process to obtain an ideal and reproducible distribution of the glue. The beams 103 are then pressed against the panel 102, for example by a mechanical press that applies the pressure required according to the specifications of the glue, for a time period necessary for the polymerization of the glue. Instead of using a mechanical press, the glued beams 103 may be pressed against the panel 102 by screws, screwed in from the panel side. The screws will remain in the finished floor cassette, in which the connection between the beams 103 and the panel 102 is therefore established by the glue and by the screws.

The use of glue based on PUR in combination with an automated process for assembling the beams 103 to the panel 102 has resulted in a structure that has a high mechanical strength compared to existing floor cassettes that have an open structure, thus without the beams being mounted between two parallel panels. This has enabled the inventors to produce floor cassettes having a span greater than 6 meters, preferably between 6 and 12 m, that necessitate only two support points (like the two walls 111 in FIG. 14).

The invention is equally related to the use of one or more cassettes according to the invention for constructing a floating floor, and to a floating floor comprising one or more cassettes according to the invention. When applying cassettes which are provided only with the support devices 2, the above-named use is equivalent to a method comprising the steps of:

mounting one or more cassettes 101 according to the invention on support structures such as walls or their equivalent (e.g. rows of pillars), wherein each cassette is supported by at least two support structures, mounting acoustic elements 118 on the central parts 3 of the support devices 2 of said one or more cassettes, mounting joists 117 onto said acoustic elements 118, the joists being oriented transversely to the central parts 3, wherein the upper surface of the joists 117 is at a height that is superior to the beams 103 of the one or more cassettes 101, mounting one or more floor boards 100 onto said joists, to thereby form a floating floor, i.e. a floor that is not directly attached to the beams 103.

The second step of the above method is not required when cassettes are used which are already provided with acoustic elements 118. The second and third step of the above method are not required when cassettes are used which are already provided with acoustic blocks and with joists 117.

The invention claimed is:

1. A Method for mounting a floating floor on a beam structure comprising a plurality of parallel beams, the method comprising the following steps:

positioning a plurality of devices placed at a regular distance, fixing said devices to the beams, the devices comprising:

a horizontally oriented support configured to support a joist on which the floor rests, and at least one fixing element comprising a vertical part configured to be fixed to at least one lateral wall of a beam, the support being connected to the fixing element, mounting joists by inserting elements consisting of an acoustic insulating material on the supports of the devices, each joist being carried by at least two supports, a combined height of the joists and the acoustic elements being such that an upper surface of the joists is located at a greater height than the beams of the beam structure, mounting the floor on the upper surfaces of the joists.

2. The method according to claim 1, in which at least one fixing element is an angle-bracket-shaped element, comprising said vertical part and a horizontal part, the horizontal part being configured to be fixed to an upper surface of a beam and the vertical part being configured to be fixed at least to a lateral wall of the same beam, the support being connected to the vertical part of the angle-bracket-shaped element, the combined height of the joists and the acoustic elements being such that the upper surface of the joists is situated at a greater height than the horizontal parts of the angle-bracket-shaped elements of the devices.

3. The method according to claim 2, in which the support is uniform with the fixing element or the fixing elements.

4. The method according to claim 2, in which the fixing elements comprise a second horizontal part that supports the support and in which the support is attached to the second horizontal part or can pivot relative to the second horizontal part about a substantially vertical axis.

5. The method according to claim 2, in which one or more of the devices take the form of a stirrup configured to be mounted between two adjacent beams, in which:

the stirrup comprises a central part that serves as said support, the central part being oriented horizontally when the device is mounted on the beam structure, the stirrup comprises two ends, each end forming one of said angle-bracket-shaped elements, the central part being connected to the vertical parts of the two ends.

6. The method according to claim 1, in which the fixing element is an angle-bracket-shaped element, comprising a vertical part and a horizontal part, the vertical part being configured to be fixed at least to a lateral wall of a beam, the horizontal part being configured to carry the support.

7. The method according to claim 6, in which the support is attached to the horizontal part or can pivot relative to the horizontal part about a substantially vertical axis.

8. The method according to claim 6, in which one or more of the devices take(s) the form of a stirrup configured to be mounted on the beam structure between two adjacent beams, in which:

the stirrup comprises a central part that serves as said support, the central part being oriented horizontally when the device is mounted on the beam structure, the stirrup comprises two ends, each end forming one of said angle-bracket-shaped elements, the central part being supported by the horizontal parts of the ends.

9. The method according to claim 5, in which the ends are attached to the central part and oriented at obtuse angles different from 180° defined relative to the central part in a horizontal plane when the device is installed on the beam structure, said angles being opposite to each other.

10. The method according to claim 5, in which the central part of the devices is formed by a steel bar or a wooden bar.

11. The method according to claim 5, in which the central part comprises two parts, one being movable relative to the other so as to render a length of the central part adjustable.

12. The method according to claim 11, in which the two parts of the central part are in the form of bars, the first part being movable inside the second part.

13. The method according to claim 1, in which one or more of the devices is made from a steel plate, or formed by assembling a plurality of parts of a steel plate.

14. The method according to claim 1, in which one or more of the devices is configured to be mounted on a single beam, the device comprising a support connected on one side to the vertical part of the fixing element.

15. The method according to claim 1, in which the devices comprise at least one stirrup, configured to be mounted between two adjacent beams, in which:

the stirrup comprises a central part that serves as said support, the central part being oriented horizontally when the device is mounted on the beam structure, the stirrup comprises two ends, each end forming one of said angle-bracket-shaped elements, the central part being connected to the vertical parts of the two end; and in which at least one of the joists is not mounted in the middle of the central part of the stirrups that support said joist.

16. The method according to claim 1, further comprising placing an insulating material between a plurality of pairs of adjacent beams.

17. The method according to claim 16, in which the insulating material is retained in place by support means that are connected to the devices.

18. The method according to claim 17, in which the placing of the insulating material comprises the steps consisting of:

Suspending one or more laths under the supports of the devices, the laths being transverse relative to the devices, Mounting elements in said insulating material on the laths.

19. The method according to claim 17, in which placing the insulating material comprises the steps consisting of:

Mounting one or more strips that have straight parts and parts that are bent around the supports of the devices, the strips being transverse relative to the devices, Mounting elements in said insulating material on the straight parts of the strips.

20. A floating floor structure to be mounted on the beams of a beam structure, said floating floor structure comprising:

a plurality of devices, each device comprising: a support oriented horizontally and configured to support a joist on which the floor rests, at least one fixing element, comprising a vertical part configured to be fixed at least to a lateral wall of a beam, the support being connected to the fixing element;

a plurality of joists mounted on the supports of the devices, with acoustic insulating material elements inserted between the joists and the supports, each joist being carried by at least two supports, a combined height of the joists and the acoustic elements being such that an upper surface of the joists is situated at a greater height than the beams of the beam structure as well as, if applicable, a greater height than the horizontal parts of the devices, said horizontal parts being fixed to the upper surface of the beams, a floor mounted on the joists and that does not come into contact with the beams of the beam structure.

21. The floating floor structure according to claim 20, further comprising an insulating material mounted between a plurality of pairs of adjacent beams.

22. The floating floor structure according to claim 21, in which the insulating material takes the form of elements in said insulating material that are maintained in place by support means connected to the devices.

23. The floating floor structure according to claim 22, in which the support means comprise one or more laths suspended under the devices, the laths being transverse relative to the devices.

24. The floating floor structure according to claim 22, in which the support means comprise one or more strips that have straight parts to support the elements in said insulating material and parts that are bent around the supports of the devices, the strips being transverse relative to the devices.

25. A kit of parts for execution of the method according to claim 1, comprising:

a plurality of devices, each device comprising a support oriented horizontally and configured to support a joist on which the floor rests, at least one fixing element, comprising a vertical part configured to be fixed at least to a lateral wall of a beam, the support being connected to the fixing element, and/or a plurality of components of said devices, a plurality of joists, a plurality of elements in an acoustic insulating material, to be installed between the devices and the joists, a plurality of panels to form the floor.

26. A kit of parts according to claim 25, further comprising a plurality of insulating material elements to form an insulation between a plurality of pairs of adjacent beams.

27. A kit of parts according to claim 26, in which the kit further comprises means for supporting the elements forming an insulation between a plurality of pairs of adjacent beams, said means being suitable for being connected to the devices.

28. A kit of parts according to claim 27, in which the means for supporting the elements forming an insulation between a plurality of pairs of adjacent beams comprise laths configured to be suspended under the devices whilst being oriented transversely relative to said devices.

29. A kit of parts according to claim 27, in which the means for supporting the elements forming an insulation between a plurality of pairs of adjacent beams comprise strips configured to be bent around the supports of the devices whilst being oriented transversely relative to said supports.

* * * * *